US007361039B2

(12) United States Patent
Koehler

(10) Patent No.: US 7,361,039 B2
(45) Date of Patent: Apr. 22, 2008

(54) ELECTRICAL CONNECTOR WITHIN TUBULAR STRUCTURE

(75) Inventor: Edwin T. Koehler, Nashville, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 11/759,581

(22) Filed: Jun. 7, 2007

(65) Prior Publication Data

US 2007/0293069 A1 Dec. 20, 2007

Related U.S. Application Data

(60) Provisional application No. 60/814,671, filed on Jun. 16, 2006.

(51) Int. Cl.
*H01R 4/60* (2006.01)

(52) U.S. Cl. ..... 439/207; 439/910; 439/135; 362/431

(58) Field of Classification Search ..... 439/207, 439/135, 910; 362/431
See application file for complete search history.

(56) References Cited

U.S. PATENT DOCUMENTS 1,806,461 A * 5/1931 Holmes ..... 439/568
4,878,160 A * 10/1989 Reneau et al. ..... 362/269
4,914,258 A * 4/1990 Jackson ..... 362/431
6,612,713 B1 * 9/2003 Kuelbs ..... 362/102

* cited by examiner

*Primary Examiner*—Tho D. Ta
(74) *Attorney, Agent, or Firm*—Baker Donelson

(57) ABSTRACT

An electrical connector within a tubular structure is disclosed which includes a pole (12) having a tubular bottom portion (15) and a tubular top portion (16). The bottom portion has a top connecting end (17) having a narrowed neck (18) with a large notch (19). The pole top portion has a bottom connecting end (21) having an internal diameter sized to receive the neck of the bottom portion. The pole top portion also has a window (22) therein. A cover plate (24) is configured to be mounted over the window. The structure also includes an electrical cord (27) which provides an electrical current to a device coupled to the pole. The electrical cord has a first portion (28) terminating with a female electrical coupler or connector (29) and a second portion terminating with a male electrical coupler (32). The male coupler or connector is configured to be received within the female coupler.

6 Claims, 3 Drawing Sheets

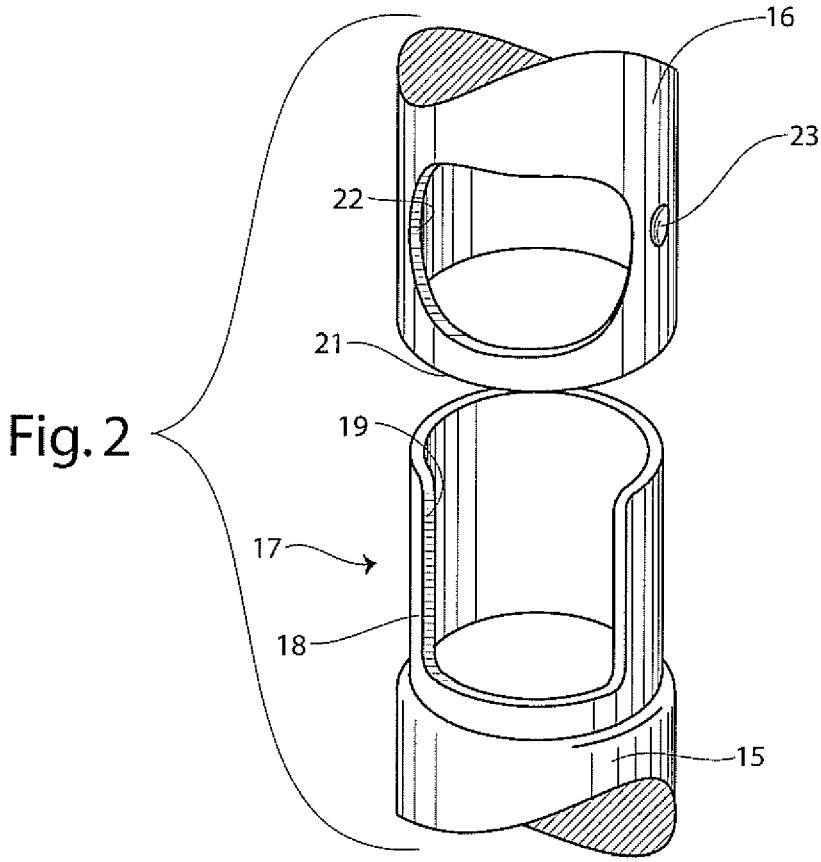
Fig. 2
Fig. 3
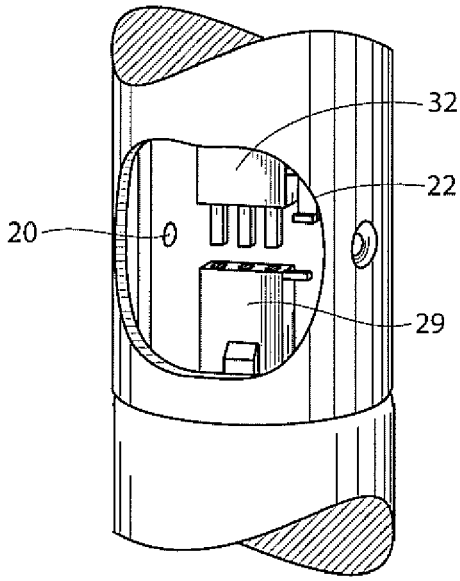
Fig. 4
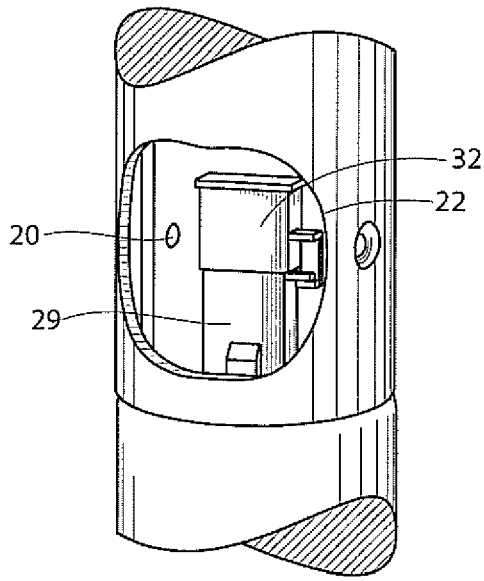

ELECTRICAL CONNECTOR WITHIN TUBULAR STRUCTURE

REFERENCE TO RELATED APPLICATION

The application claims benefit of provisional patent application Ser. No. 60/814,671 filed Jun. 16, 2006.

TECHNICAL FIELD

This invention relates generally to electrical connectors, and specifically to electrical connectors positioned within elongated tubular structures.

BACKGROUND OF THE INVENTION

Tubular structures oftentimes includes electrical wiring therethrough, such as fans mounted to the top end of an elongated pole have existed. It is often difficult to couple the electrical wiring for these tubular structures because of the length of the elongated pole.

Accordingly, it is seen that a need remains for a connector which enables one to easily connect electrical wiring within an elongated tubular structure. It is to the provision of such therefore that the present invention is primarily directed.

SUMMARY OF THE INVENTION

A tubular structure and electrical connector comprises a tubular pole having a first pole portion and a second pole portion, the first pole portion has a first connecting end configured to be telescopically received within a second connecting end of the second pole portion. The first pole portion is rotatable relative to the second pole portion. The first connecting end of the first pole portion has a first opening therein. The second connecting end of the second pole portion has a second opening therein which is alignable with the first opening. The tubular structure and electrical connector also includes an electrical connector positioned within the tubular pole. The electrical connector includes a first connector portion positioned within the first pole portion adjacent the first opening and a second connector portion positioned within the second pole portion adjacent the second opening. With this construction, with the first connecting end of the first pole portion received within the second connecting end and the first opening aligned with the second opening, one may reach through the openings to connect the first connector portion to the second connector portion, then rotate the first pole portion relative to the second pole portion to mis-align the first and second openings and thereby seal the interior of the tubular pole from ambience.

BRIEF DESCRIPTION OF THE DRAWING

FIGS. 2-6 are a series of views illustrating the method of connecting the electrical connector with tubular structure of FIG. 1

DETAILED DESCRIPTION

Figure 1:
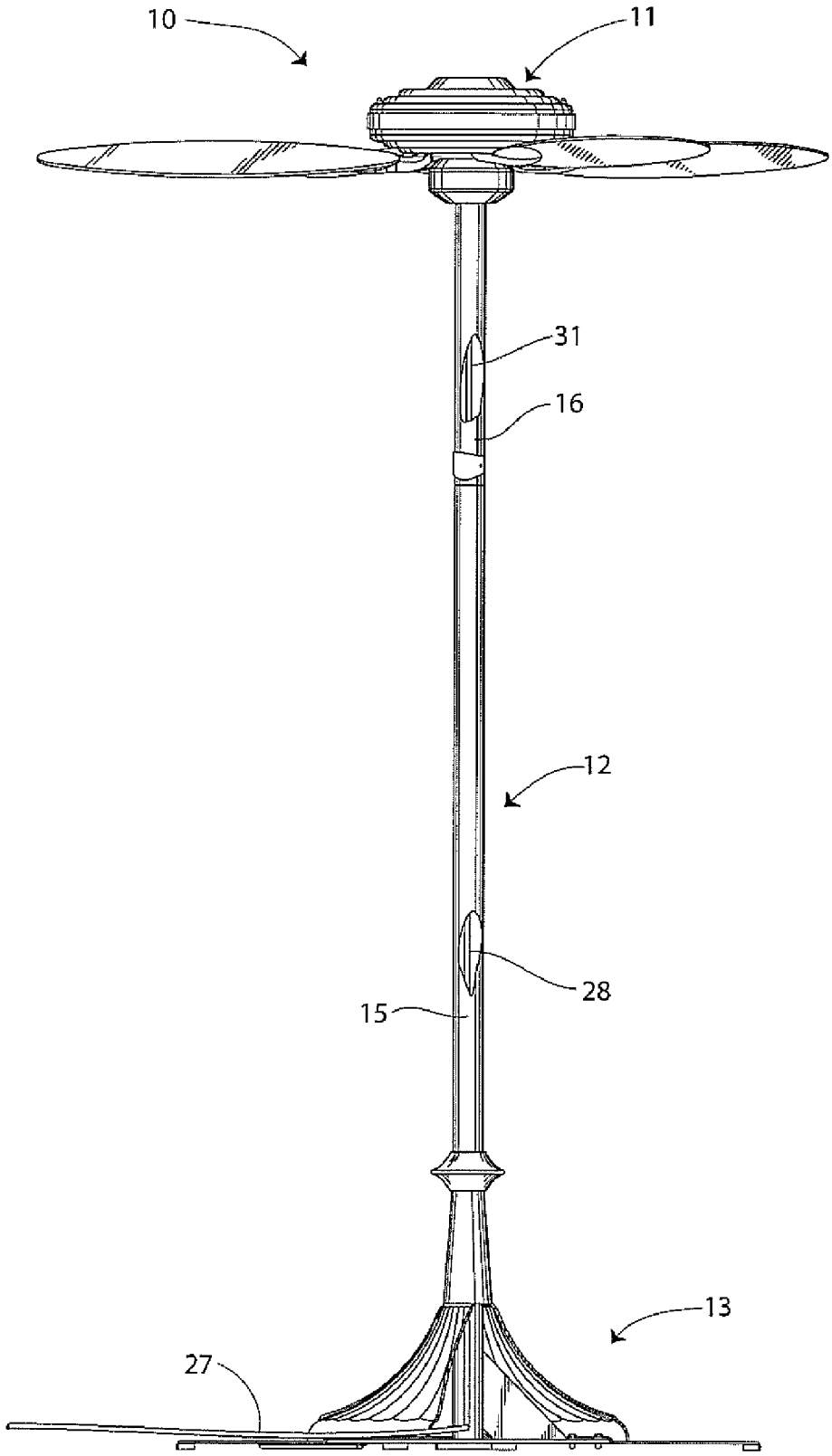
FIG. 1 is a side view of an electrical connector with tubular structure shown in the form of a pole mounted fan that embodies the invention in its preferred form.

FIG. 1 illustrates an electrical connector with tubular structure in the form of a pole fan 10. The pole fan 10 includes a generally conventional ceiling fan motor assembly 11 mounted to the top end of an elongated tubular pole 12 opposite a pedestal base 13.

The pole 12 includes a tubular bottom portion 15 and a tubular top portion 16. As best shown in FIG. 2, the bottom portion 16 has a top connecting end 17 having a narrowed neck 18 with a large notch 19 therein extending from the top end 17 and two threaded screw mounting holes 20. The pole top portion 16 has a bottom connecting end 21 having an internal diameter sized to receive the neck 18 of the bottom portion. The pole top portion 16 also has a window 22 therein and a pair of screw holes 23 on either side of the window 22. A cover plate 24 is configured to be mounted over the window 22. The cover plate 24 has a pair of oppositely disposed screw holes 25 configured to allow the passage of mounting screws 26 which are threadably mounted within the underlying screw mounting holes 20 within the bottom portion 15.

The fan 10 also includes an electrical cord 27 which provides an electrical current to the motor assembly 11. The electrical cord 27 has a first portion 28 terminating with a female electrical coupler or connector 29 located near the top end 17 of the pole bottom portion 15, and a second portion terminating with a male electrical coupler 32 located near the bottom end 21 of the pole top portion 15. The male coupler or connector 32 is configured to be received within the female coupler 29.

In use, the fan 10 is packaged in an unassembled configuration. To assemble the fan, the pole bottom portion 15 is mounted to the base 13 with the electrical cord first portion 28 passing through the pole bottom portion 15 so that its female coupler 29 is located adjacent the top end 17 of the pole bottom portion 15. Similarly, the motor assembly 11 is mounted to the top end of the pole top portion with the cord second portion 31 extending through the pole top portion 16 so that male coupler 32 is located at the bottom end 21 of the pole top portion. It should be understood that the cord portions 28 and 31 and their respective couplers 29 and 32 may be pre-assembled at the factory prior to be shipped.

The pole top portion 16 is mounted to the pole bottom portion 15 so that the neck 18 passes into the bottom end 21 of the top portion. The top portion 16 is positioned relative to the bottom portion 15 so that the window 22 is aligned with notch 19, as shown in FIG. 3. As such, an operator may reach through the window 22 and notch 19 to manipulate and coupled the cord couplers 29 and 32 together, as shown in FIG. 4.

Figure 5:
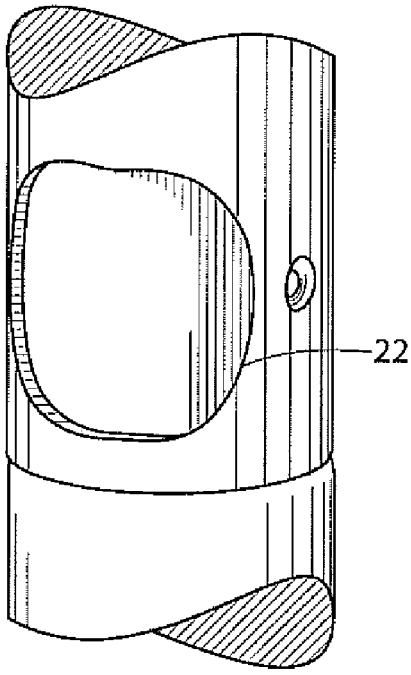
Figure 6:
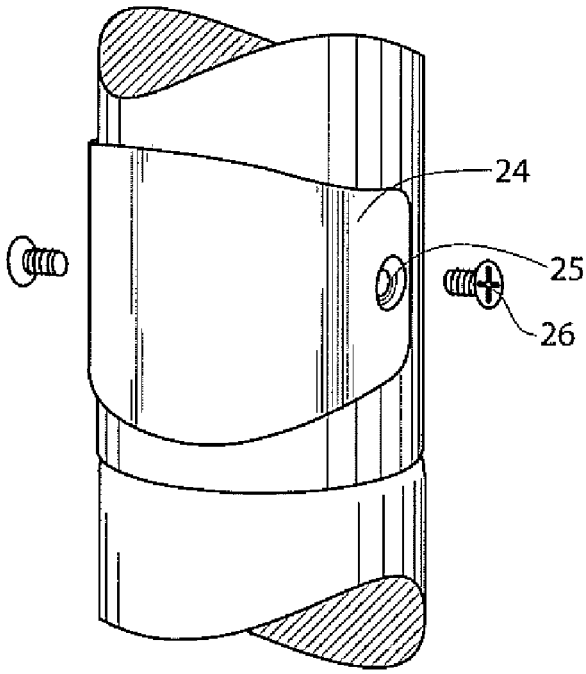

Next, the pole top portion 16 is rotated approximately 180 degrees so that the notch 19 is not viewable through window 22 and screw holes 23 are aligned with threaded screw holes 20, as shown in FIG. 5. The cover plate 24 is then placed over window 22 and screws 26 are passed through holes 25 and 23 and threaded into screw mounting holes 20.

The rotation of the pole results in the mis-aligning of the window with the notch. This mis-alignment restricts moisture from entering the interior of the pole, i.e., it seals the interior of the pole from ambience. The cover plate 24 further seals the pole from moisture.

It should be understood that the present invention was described with reference to a fan, however, it should be understood that any type of tubular and electrical connection may be covered by the inventive concept.

It should be understood that additional screw holes may be incorporated into the present invention to secure the two pole portions together.

It thus is seen that a tubular electrical connection is now provided. Although it has been shown and described in its preferred form, it should be understood that other modifications, additions or deletions may be made thereto without departure from the spirit and scope of the invention as set forth in the following claims.

The invention claimed is:

1. A tubular structure and electrical connector comprising:

a tubular pole having a first pole portion and a second pole portion, said first pole portion having a first connecting end configured to be telescopically received within a second connecting end of said second pole portion, said first pole portion being rotatable relative to said second pole portion, said first connecting end of said first pole portion having a first opening therein, said second connecting end of said second pole portion having a second opening therein which is alignable with said first opening; and an electrical connector positioned within said tubular pole, said electrical connector including a first connector portion positioned within said first pole portion adjacent said first opening and a second connector portion positioned within said second pole portion adjacent said second opening, whereby with the first connecting end of the first pole portion received within said second connecting and the first opening aligned with the second opening, one may reach through the openings to connect the first connector portion to the second connector portion, then rotate the first pole portion relative to the second pole portion to mis-align the first and second openings and thereby seal the interior of the tubular pole from ambience.

2. The tubular structure and electrical connector of claim 1 wherein said first opening is a notch.

3. The tubular structure and electrical connector of claim 1 further comprising a cover plate removably mounted to said second pole portion to cover said second opening.

4. A tubular structure and electrical connector comprising:

a first tube having a connecting end with an opening therein;

a second tube having a connecting end with an opening therein;

said first tube connecting end being configured to be received and rotated within said second tube connecting end with said first tube opening alignable with said second tube opening;

a first electrical coupler positioned within said first tube; and a second electrical coupled positioned within said second tube and configured to mate with said first electrical coupler, whereby with the first tube received within said second tube and the first tube opening aligned with the second tube opening, one may reach through the openings to connect the first electrical coupler to the second electrical coupler, then rotate the first tube relative to the second tube to mis-align the openings and thereby seal the interior of the first and second tubes from ambience.

5. The tubular structure and electrical connector of claim 4 wherein said first tube opening is a notch.

6. The tubular structure and electrical connector of claim 4 further comprising a cover plate removably mounted to said second tube opening.

* * * * *